US005876067A

United States Patent [19]

Kaplan

[11] Patent Number: 5,876,067

[45] Date of Patent: Mar. 2, 1999

[54] TELEPHONE MESSAGE WRITING PAD

[76] Inventor: Seymour Kaplan, 700 Front St., No. 2505, San Diego, Calif. 92101

[21] Appl. No.: 233,215

[22] Filed: Apr. 25, 1994

Related U.S. Application Data

[63] Continuation of Ser. No. 900,674, Jun. 19, 1992, abandoned.

[51] Int. Cl.[6] ..... B42D 5/00; B42D 1/00

[52] U.S. Cl. ..... 281/15.1; 281/38; 283/61; 283/62; D19/1

[58] Field of Search ..... 281/15.1, 31, 51, 281/38; 283/61, 62; 40/404, 405, 121, 360; 428/80; D19/1, 27

[56] References Cited

U.S. PATENT DOCUMENTS

| | | | |
|---|---|---|---|
| D. 142,670 | 10/1945 | Rogow | D19/27 |
| 1,449,145 | 3/1923 | Clarkson | 281/38 |
| 2,075,529 | 3/1937 | Leubrie | 281/38 X |
| 2,274,944 | 3/1942 | Trussell . | |
| 3,258,277 | 6/1966 | Schuster . | |
| 4,810,007 | 3/1989 | Nam | 281/15.1 |
| 4,902,042 | 2/1990 | Rassi | 40/121 |
| 4,971,361 | 11/1990 | Whiting | 281/15.1 X |

FOREIGN PATENT DOCUMENTS

| | | | |
|---|---|---|---|
| 1213284 | 3/1960 | France | 281/15.1 |

OTHER PUBLICATIONS

"Current®", Christmas 1986, pp. 52–53, Item 518 & 520 Memo Pads.

"The Personal Touch™", An Artistic Greetings Catalog®, Fall 1994, p. 39, Item A. A to Z Initial Pads.

*Primary Examiner*—Frances Han
*Attorney, Agent, or Firm*—Frank D. Gilliam

[57] ABSTRACT

A writing pad having extendable tabs to be secured by an elbow to prevent move of the pad when the writer is holding a telephone with one hand and writing with the other. The tabs are extendable from the pad for either right or left handed persons.

2 Claims, 2 Drawing Sheets

TELEPHONE MESSAGE WRITING PAD

This is a continuation application Ser. No. 07/900,674 filed on Jun. 19, 1992 now abandoned.

BACKGROUND OF THE INVENTION

The invention is directed to message pads and more particularly to message pads for writing thereon while holding a telephone and talking thereon.

Almost everyone at one time or an other has talked on a telephone and attempted to hold the telephone to their ear and while doing so attempted to take messages and the like and write them down on various type note pads, scrapes of paper or any thing handy. In most instances the pad or scrape of paper slides around making it nearly impossible to write thereon or at least to write in a legible manner.

Secretaries taking short hand from the telephone while holding the telephone to the ear find difficulty in transcribing their notes due to the movement of the steno pad along its support surface while trying to write thereon with no means to steady the steno pad from movement.

There has not been a satisfactory solution to this problem until the emergence of the instant invention.

SUMMARY OF THE INVENTION

The invention is directed to a new and unique memo pad or steno pad configuration which prevents movement of the pad by the placement of the elbow of the arm supporting the phone on a protrusion extending at least from the lower end of the pad. By turning the pad over the same pad can be used to either right or left handed persons. Other pads have inner folded extensions that can be folded outward in a direction dictated by the phone support arm of the user. In order to keep messages in the normal expected configuration, i.e. a known and expected rectangular shape, the extension of the writing surface of the pad which is held by the elbow while taking messages can be frangible and removed after the messages are taken thusly presenting a symmetrical rectangular shape.

An object of this invention is to provide a message pad that can be held in place by the writer while the writer is holding and talking on a telephone while writing down a message.

Another object of this invention is to provide an protrusion which extends from the normal writing surface of a pad on which a telephone user can place an elbow to steady the pad from movement while the telephone user is writing on that pad.

Still another object of this invention is to provide a writing pad which has fold out areas on which a telephone user can place an elbow while talking on a telephone and writing on that pad.

Yet another object of this invention is to provide a message pad which has a protrusion which is frangible and can be torn away from the normal expected rectangular surface area of a note pad so that the protrusion can be easily removed for message storage.

Other objects and features of the invention will become apparent as the drawings which follow are understood by reading the corresponding description thereof.

BRIEF DESCRIPTION OF THE DRAWING FIGURES

DETAILED DESCRIPTION OF THE PREFERRED EMBODIMENTS

Figure 1:
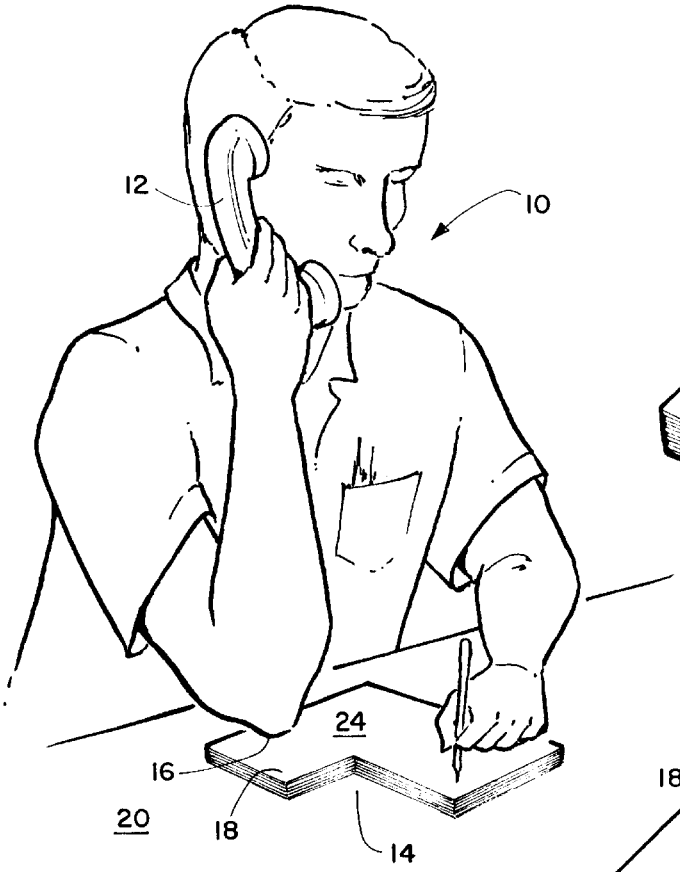
FIG. 1 depicts a telephone user making notes on a first embodiment of a note pad with a protrusion for placement of the elbow of the user to hold the pad in position for writing.
Figure 2:
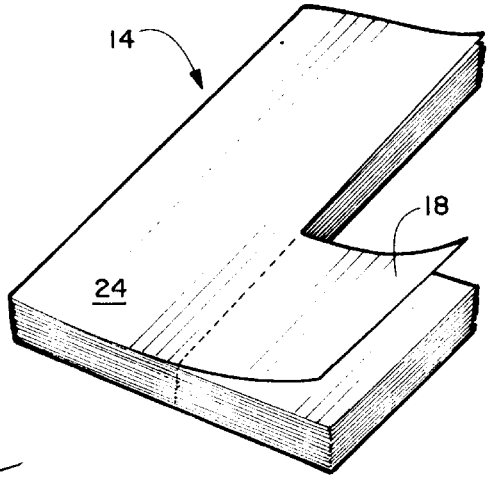
FIG. 2 depicts the note pad of FIG. 1 for a left hand person.
Figure 3:
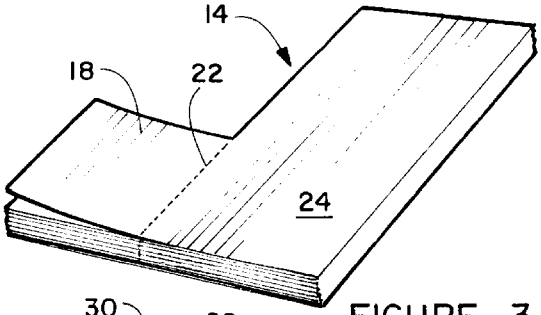
FIG. 3 depicts the note pad of FIG. 1 for a right hand person which also includes a frangible tare-away protrusion.

Referring now to the drawing Figures and particularly to drawing FIGS. 1–3, A person 10 talking on a telephone 12 is firmly holding a memo pad 14 by an elbow 16 of the phone supporting arm while whiting a message on the memo pad 14 of the invention. The memo pad 14 includes an extension or protrusion 18 on which the elbow is positioned for holding the pad in a fixed position on a support surface 20. FIG. 2 is a showing of the pad 14 of drawing FIG. 1 and drawing FIG. 3 depicts the pad of drawing FIG. 1 turned over so as to accommodate a left handed person in the same manner as the right handed person of drawing FIG. 1.

In drawing FIG. 3, a frangible line 22 provides for a way to remove the extension or protrusion 18 to make the memo a more acceptable rectangular configuration for storage or the like. It should be understood that when the extension or protrusion 18 is grasped and pulled while holding the central or message recorded portion 24 of the memo pad in a fixed position the extension or protrusion 18 will easily tare-away from the rectangular message recorded portion 24.

Figure 4:
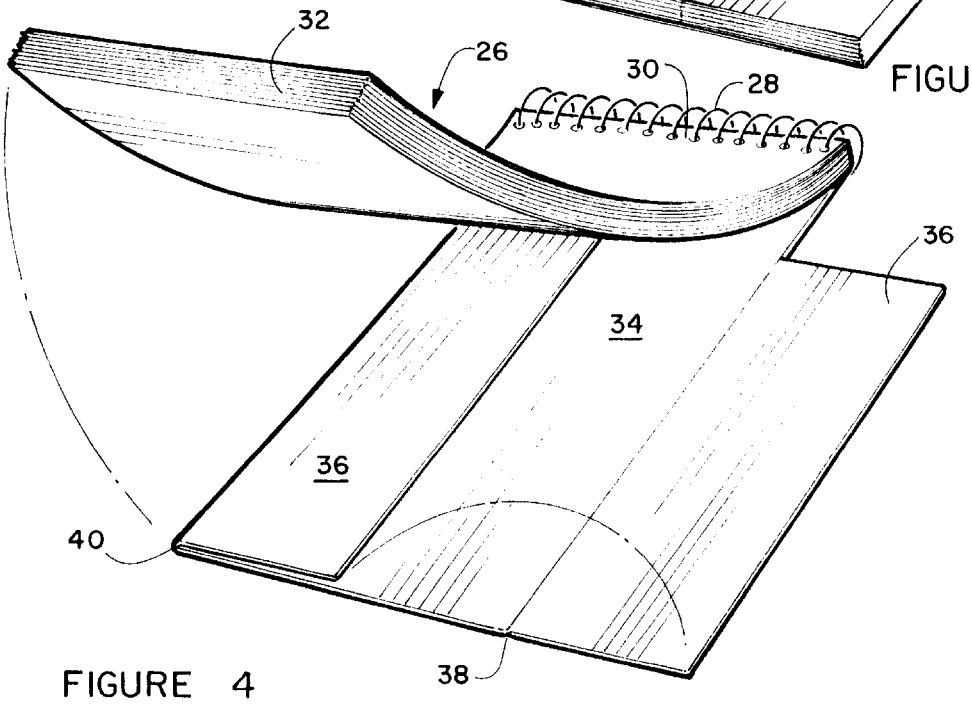
FIG. 4 depicts a second embodiment of the invention in combination with a conventional steno pad with fold out extensions for the same purpose as shown in FIG. 1.

Referring now specifically to drawing FIG. 4, this Figure depicts a conventional steno pad 26. The steno pad 26 includes the conventional spiral wire coil 28 at the top 30 which rotatably connects the writing paper 32 to the hard back 34.

The hard back 34 includes a pair of back extensions 36 one being on each side of the hard back 34. The extensions 36 fold along a hinge lines 38, 40 and when in a stowed position as shown on the left had side of he drawing FIG. 4 do not extend beyond the normal expected boundaries of a conventional steno pad. When the extensions 36 are folded out from their adjacent to the hard back 34 position shown on the left hand side of drawing FIG. 4 to a deployed position as shown on the right hand side of FIG. 4, the steno pad can be used as is the memo pad 14 of drawing FIG. 1, i.e. held down by the elbow of the person on the telephone to prevent movement while writing thereon.

It should be understood that generally only one of the extensions 36 will be rotated to the deployed position while the steno pad is used by a person on the telephone that one will depend on whether the person is right or left handed.

When both of the extensions 36 are in there stowed positions the steno pad 26 has the normal expected appearance of a conventional and well known steno pad.

It should be further understood that either the large area or the small area can be used to record the message thereon, i.e. if the message is sufficiently small then the message can be written on the small area while the pad is held in place by placement of the elbow on the larger portion and vice versa. This feature is particularly adapted for the pads having the frangible line for tearing away the unused portion of the writing surface, i.e. the small portion can be separated and saved when the message is written thereon and the larger portion can be left on the pad for a later message recordation.

Figure 5:
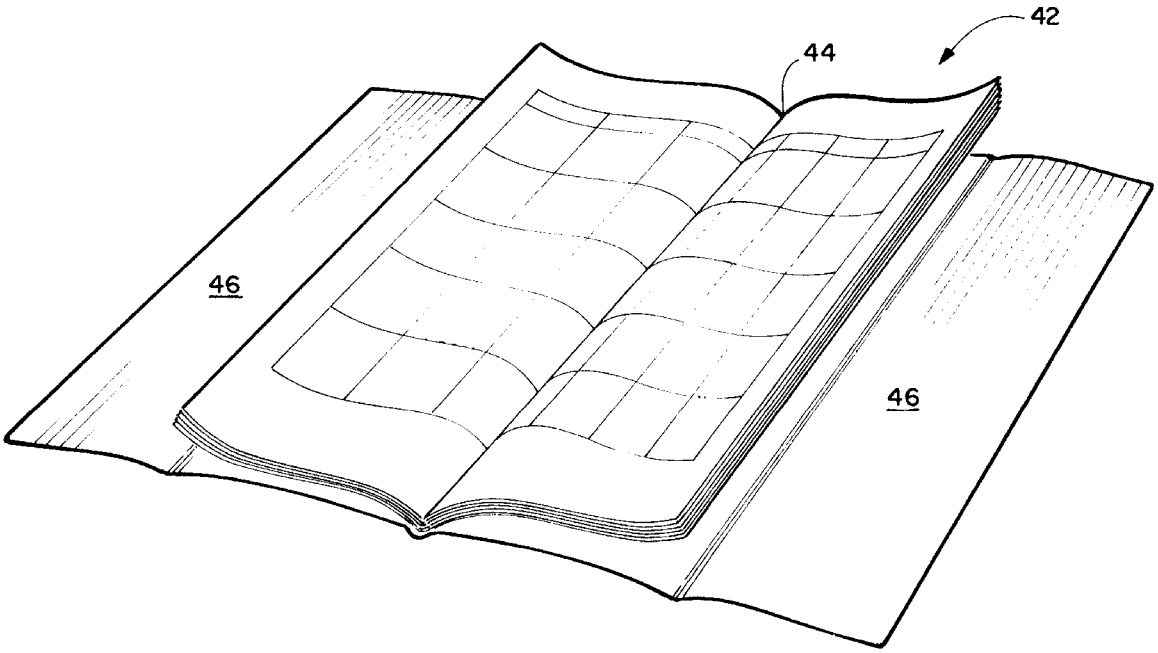
FIG. 5 depicts a third embodiment of the invention for use with a memo calendar with a vertical hinge between opposed calendar memo pages.

Referring now to drawing FIG. 5, a memo calendar 42 is shown with a central vertical hinge means 44 and foldouts 46 for positioning of the elbow when holding and talking on a phone and writing information in the calendar 42 at the same time.

Figure 6:
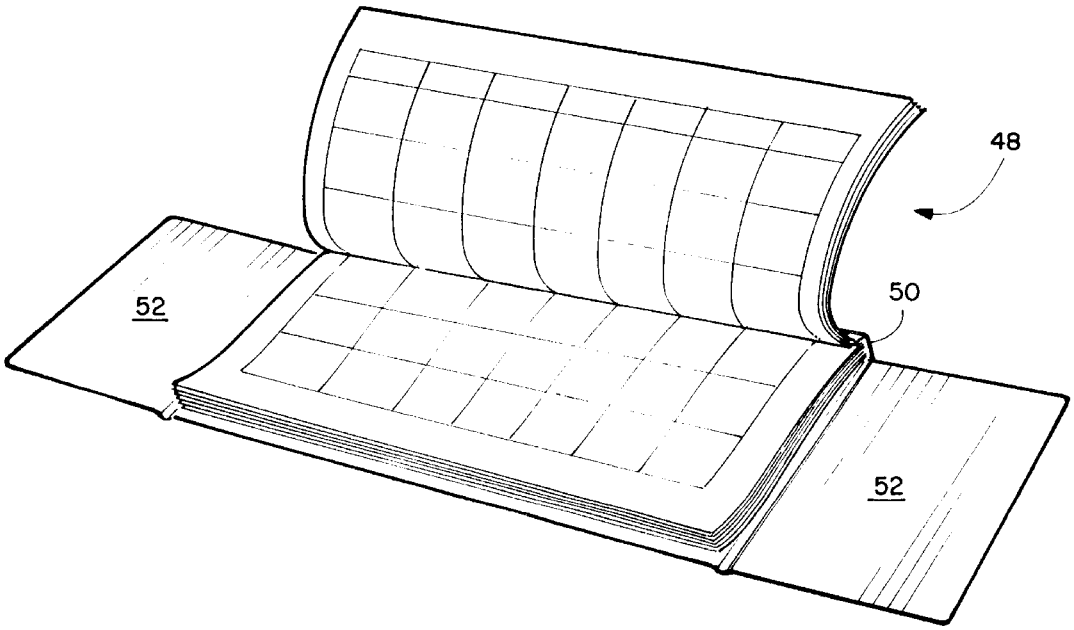
FIG. 6 depicts a fourth embodiment of the invention for use with a memo calendar with a horizontal hinge between the opposed pages.

Referring now to drawing FIG. 6, a memo calendar 48 is shown with a central horizontal hinge means 50 and fold out elbow positioning extensions 52.

While a specific embodiments of telephone message pad, steno pad and calendar memo pads have been shown and fully explained above for the purpose of illustration it should be understood that many other uses will be found for the invention and many alterations, modifications and substitutions may be made to the instant invention without departing from the spirit and scope of the invention as defined by the appended claims.

What is claimed is:

1. A reversible writing pad having a substantially rectangular writing surface for writing messages thereon by either a left or right handed person while simultaneously holding a telephone instrument by one hand of an arm of that person and resting the elbow of that arm on a firm surface while that person uses the opposite hand for writing a message on said reversible pad comprising;

said writing pad having a plurality of vertically stacked sheets of writing paper with a writing surface on both sides of said sheets suitable for writing messages thereon; and a substantially rectangular extension extending from said rectangular writing surface of each of said plurality of said vertically stacked sheets of writing paper, said extension utilized for placement between said elbow and the firm surface with the top exposed, said extension of said stacked sheets positioned directly beneath said elbow of said that person so that the writing pad is held in place by said elbow while that person is writing on the upper most writing surface thereof with said other hand, said writing surface and said extension together reversible for forming a substantially "L" shaped combined writing surface and extension with said extension forming a lower portion of the L for a left handed person and the lower portion of a backward "L" for a right handed person, said writing pad having a frangible line between said substantially rectangular writing surface and said extension so that the extension can be easily removed from said rectangular writing surface along said frangible line.

2. The writing pad of claim 1 wherein either a message or extension of said pad can have a message recorded thereon and removed and the unused portion of the pad can be then used for a second message.

* * * * *